US007922469B2

(12) United States Patent
Agner

(10) Patent No.: US 7,922,469 B2
(45) Date of Patent: Apr. 12, 2011

(54) PUMP

(75) Inventor: Ivo Agner, Buehl (DE)

(73) Assignee: Luk Fahrzeug-Hydraulik GmbH & Co. KG, Bad Homburg V.D.H. (DE)

( * ) Notice: Subject to any disclaimer, the term of this patent is extended or adjusted under 35 U.S.C. 154(b) by 190 days.

(21) Appl. No.: 10/562,260

(22) PCT Filed: Jun. 19, 2004

(86) PCT No.: PCT/DE2004/001284

§ 371 (c)(1),
(2), (4) Date: Feb. 5, 2007

(87) PCT Pub. No.: WO2005/001289

PCT Pub. Date: Jan. 6, 2005

(65) Prior Publication Data

US 2007/0128065 A1 Jun. 7, 2007

(30) Foreign Application Priority Data

Jun. 30, 2003 (DE) ..... 103 29 284

(51) Int. Cl.
*F03C 2/00* (2006.01)
*F03C 4/00* (2006.01)

(52) U.S. Cl. ..... 418/259; 418/15; 418/28; 418/238; 418/268

(58) Field of Classification Search ..... 418/15, 418/77, 82, 83, 225, 238, 259, 263, 266–269
See application file for complete search history.

(56) References Cited

U.S. PATENT DOCUMENTS

| | | | | |
|---|---|---|---|---|
| 2,588,430 | A | 3/1952 | Svenson | |
| 2,731,919 | A * | 1/1956 | Prendergast | 418/28 |
| 5,975,868 | A * | 11/1999 | Agner | 418/259 |
| 6,164,928 | A | 12/2000 | Agner | |
| 6,244,830 | B1 | 6/2001 | Agner | |
| 6,817,847 | B2 | 11/2004 | Agner | |

FOREIGN PATENT DOCUMENTS

| | | |
|---|---|---|
| DE | 1 011 284 | 6/1957 |
| DE | 43 27 106 A1 | 2/1995 |
| DE | 197 10 378 C1 | 3/1998 |
| DE | 100 27 990 A1 | 12/2001 |

* cited by examiner

*Primary Examiner* — Theresa Trieu
(74) *Attorney, Agent, or Firm* — Davidson, Davidson & Kappel, LLC

(57) ABSTRACT

A pump, for example, a vane-cell pump or a roll-cell pump, especially a gear pump, includes a two-stroke pump contour which includes at least one rise zone, at least one large circular area, at least one fall zone and at least one small circular area. The pump includes a rotor with radially displaceable vanes or rolls arranged in radial slits inside the pump contour.

11 Claims, 4 Drawing Sheets

PUMP

BACKGROUND

The present invention relates to a pump, such as a vane-type pump or a roller-cell pump, in particular a transmission pump, having a double-stroke delivery contour, the delivery contour having at least one rise zone, at least one large circle region, at least one fall zone, and at least one small circle region, and, within the delivery contour, the pump having a rotor having radially displaceable vanes or rollers in radial rotor slots.

Pumps of this kind are generally known. The problem in this context is that transmission pumps are operated using foamed transmission oil. Due to the variation in the degrees of foaming, a great disparity in the oil elasticities results. If there is a high percentage of undissolved air in the oil, the oil is very soft. Thus, given a constant reversal geometry, the pressure equalization process takes longer than when working with hard, unfoamed oil, and longer rotation angles are required for the pressure reversal operation in order to react to the substantial variance in elasticity. These rotation angles are ultimately formed by the large circle region, whose angle is only slightly greater than the vane pitch. In this region, the cell volume is virtually constant (apart from the "fall", that is a slight reduction in the vane displacement radially inwardly as a function of the rotation angle), and by using pressure equalization slots or intermediate capacities (see German Patent Application DE 100 27 990 A1), the pressure reversal can be realized gradually in small pressure increase gradients. However, these measures do not suffice for applications in which foamed transmission oil is used.

BRIEF SUMMARY OF THE INVENTION

It is, therefore, an object of the present invention to devise a pump which will overcome these disadvantages.

The present invention provides a pump, such as a vane-type pump or a roller-cell pump, in particular a transmission pump, having a two-stroke delivery contour, the delivery contour having at least one rise zone, at least one large circle region, at least one fall zone, and at least one small circle region, and, inside of the delivery contour, the pump having a rotor provided with radially displaceable vanes or rollers in radial rotor slots, and the angular range of the large circle region of the delivery contour being lengthened as compared to a standard pump.

The pump may include that, in the case of a 10-vane pump, the large circle region of the delivery contour is at least 10°-15°, preferably 13° larger than the angular pitch of the vane positions in the rotor (36°) of a 10-vane standard pump; and, in the case of a 12-vane pump, the large circle region of the delivery contour is at least 16°-25°, preferably 22° larger than the angular pitch of the vane positions in the rotor (30°) of a 12-vane standard pump. As a result, the compression region is shortened as compared to standard pumps, and the region that is available for the pressure equalization process (pressure equalization slots or intermediate capacities) is advantageously lengthened by the corresponding angle or angles.

The pump also may include that the length of the suction region remains substantially the same as that of a standard pump. By keeping a same-sized suction region, the advantage is derived that the maximum speed is still reached just as efficiently.

The present invention also may provide a pump, whereby, in the case of a 12-vane pump, the turning points of the displacement contour function in the direction from the suction region to the pressure region are spaced apart by 3.5× the vane pitch (vane pitch=30°), and the turning points in the direction from the pressure region to the suction region are spaced apart by approximately 2.5× the vane pitch. This has the advantage that the turning points optimally reside more or less in the middle of the rise and fall zones of the delivery contour, thereby providing a transition function having radii of curvature that are not too small and are easily machined.

The present invention also may provide a pump whereby, in the case of a 10-vane pump, the turning points of the displacement contour function are shifted by approximately 3° in the direction of rotation as compared to a 10-vane standard contour. Here, the advantage is derived that the superposed kinematic volume-flow pulsations of the upper-vane pump and the lower-vane pump optimally complement one another. Apart from that, the turning points are spaced apart by approximately 2.5× the vane pitch (the vane pitch of a 10-vane pump is 36°).

BRIEF DESCRIPTION OF THE DRAWINGS

Preferred embodiments of the present invention is described in the following with reference to the figures, in which.

DETAILED DESCRIPTION OF THE PREFERRED EMBODIMENTS

Figure 1:
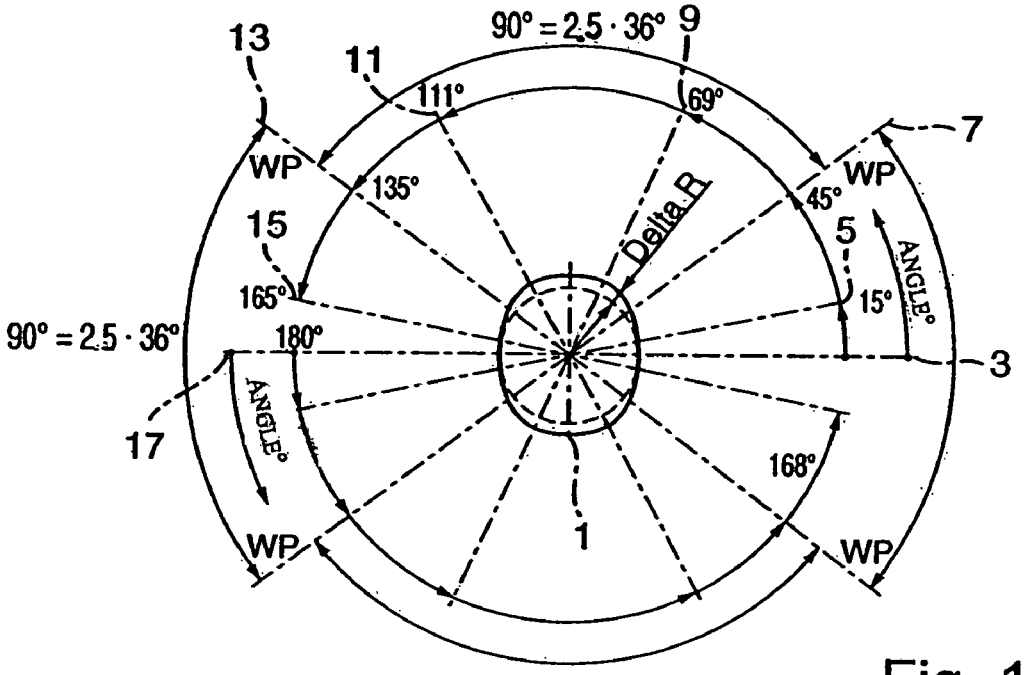
FIG. 1 shows the delivery contour of a 10-vane standard pump.

In FIG. 1, the delivery contour of a 10-vane standard pump including the corresponding angle-of-rotation points is schematically shown. A basic representation of delivery contour 1 is shown in the center of the image. It is clarified schematically in the following with reference to the angular points, these angles not being precisely shown in terms of their angular position, but only clarified schematically. The description of the delivery contour begins at angular position 3, at angle 0°, which is located in the middle of the small circle region. At angular point 5, i.e., at 15°, the small circle region passes into the rise zone (the contour is enlarged radially outwardly), in which the displacement volume between two vanes is increased and thus forms the suction region. At angular point 7, at 45°, the rise zone has a turning point in the displacement contour function (change in radius as a function of the angle of rotation) and ends finally at 69°, at angular point 9. The position of the turning points of the displacement contour function is able to be (precisely) determined by the position of the maxima and of the minima of the first derivative of the displacement contour function over the angle of rotation. Extending from angular point 9, thus from 69°, up to angular point 11, thus to 111°, is the so-called large circle region, which, however, due to the so-called "fall", i.e., a slight reduction in the displacement radially inwardly as a function of the rotation angle, ensures that the vane tips always remain pressed against the contour. The large circle region including the "fall" may also be defined in such a way that its beginning forms the maximum of the displacement contour function and its end is given as soon as there is no longer any tangential continuity in the first and/or second derivative of the displacement contour function. From point 11, thus at 111°, the actual fall zone begins, which extends to 165°, thus to angular point 15, and, therefore, constitutes the pressure region of the vane-type pump, since the displacement volume is now reduced. At angular point 13, i.e., at 135°, the fall zone has, in turn, a turning point in the displacement contour function. The turning point at point 7, i.e., in the rise zone, and the turning point at point 13, i.e., in the fall zone, are spaced apart by approximately 90°. Since the 10-vane pump has a vane pitch of 36°, this corresponds to 2.5-times the vane pitch. Thus, the turning point in the fall zone and the turning point in the next rise zone are spaced apart by 2.5 times the vane pitch. Moreover, the turning point positions are symmetrical about the main axis of the contour. Extending from 165°, i.e., from angular point 15, to 180°, i.e., to angular point 17, is, in turn, one half of the next small circle region. From 180° to 360°, i.e., from angular point 17 back to angular point 3, the delivery contour is repeated symmetrically to the previously described delivery contour half.

Figure 2:
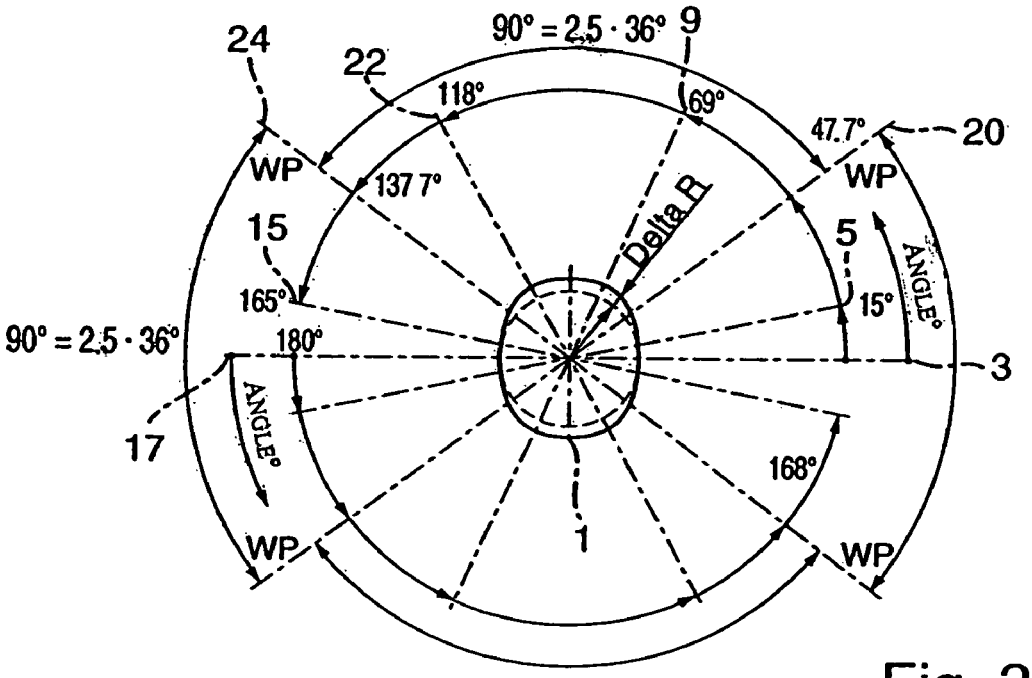
FIG. 2 shows the delivery contour of a 10-vane pump according to the present invention.

FIG. 2 shows a delivery contour according to the present invention for use in transmission pumps, having a lengthened large circle region. The description of delivery contour 1 begins, in turn, at angular point 3, i.e., at 0° in the middle of the small circle region. The rise zone in the delivery contour begins at angular point 5, i.e., at 15°, and ends, in turn, at angular point 9, at 69°. However, the turning point of the delivery contour function within the rise zone is shifted in comparison to FIG. 1 from 45 to 47.7°, i.e., to approximately 48°, or by 3° in the direction of rotation, and thus resides at new angular point 20. The large circle region of the new contour now extends from angular point 9, i.e., from 69°, to angular point 22 at 118°. This means that, compared to the large circle region of FIG. 1, the large circle region is lengthened by approximately 7°, and this lengthening is now available for longer pressure-equalization processes in order to compress undissolved air in the oil. The fall zone of the delivery contour begins at angular point 22, at 118°, and ends, in turn, at angular point 15, at 165°, which means that the pressure region is now shortened by the corresponding 7° as compared to the pressure region in FIG. 1. An important consideration is that the length of the suction region is retained from angular point 5 to angular point 9, which is advantageous with respect to reaching the maximum speed. At 137.7°, thus approximately at 138°, turning point 24 in the fall zone is advanced by 3° in the direction of rotation, which, in turn, means that both turning points retain their spacing of 90° or of 2.5× the vane pitch of the 10-vane pump (36°). At 180°, at angular point 17, this new displacement contour according to the present invention is repeated symmetrically to the top half.

Figure 3:
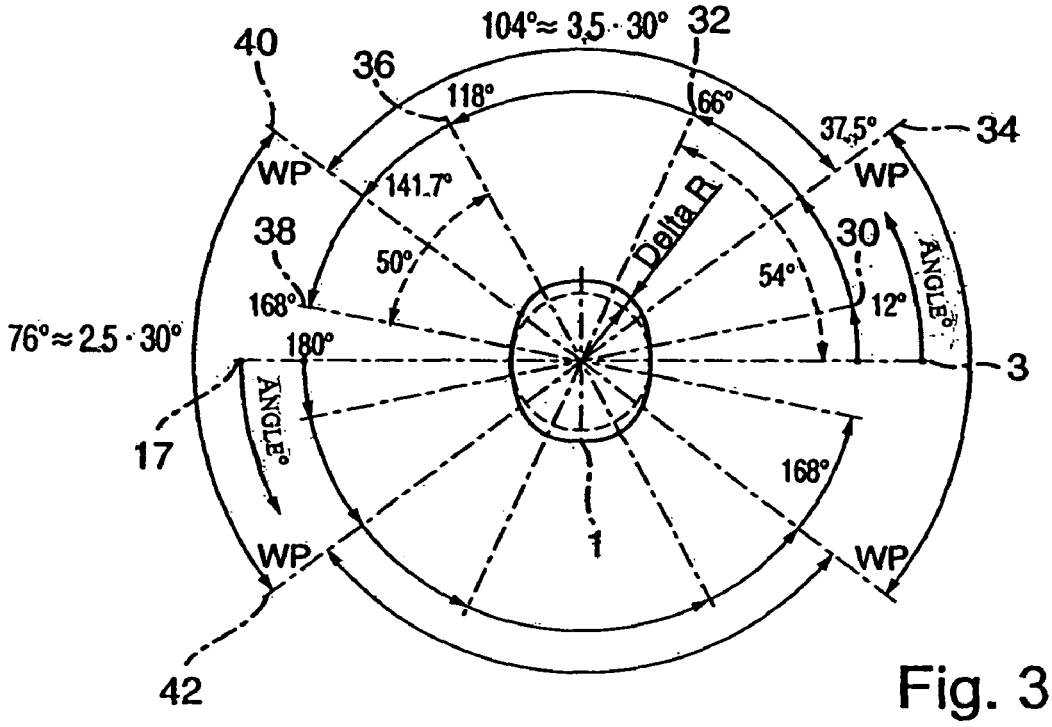
FIG. 3 shows the delivery contour of a 12-vane pump according to the present invention.
Figure 7:
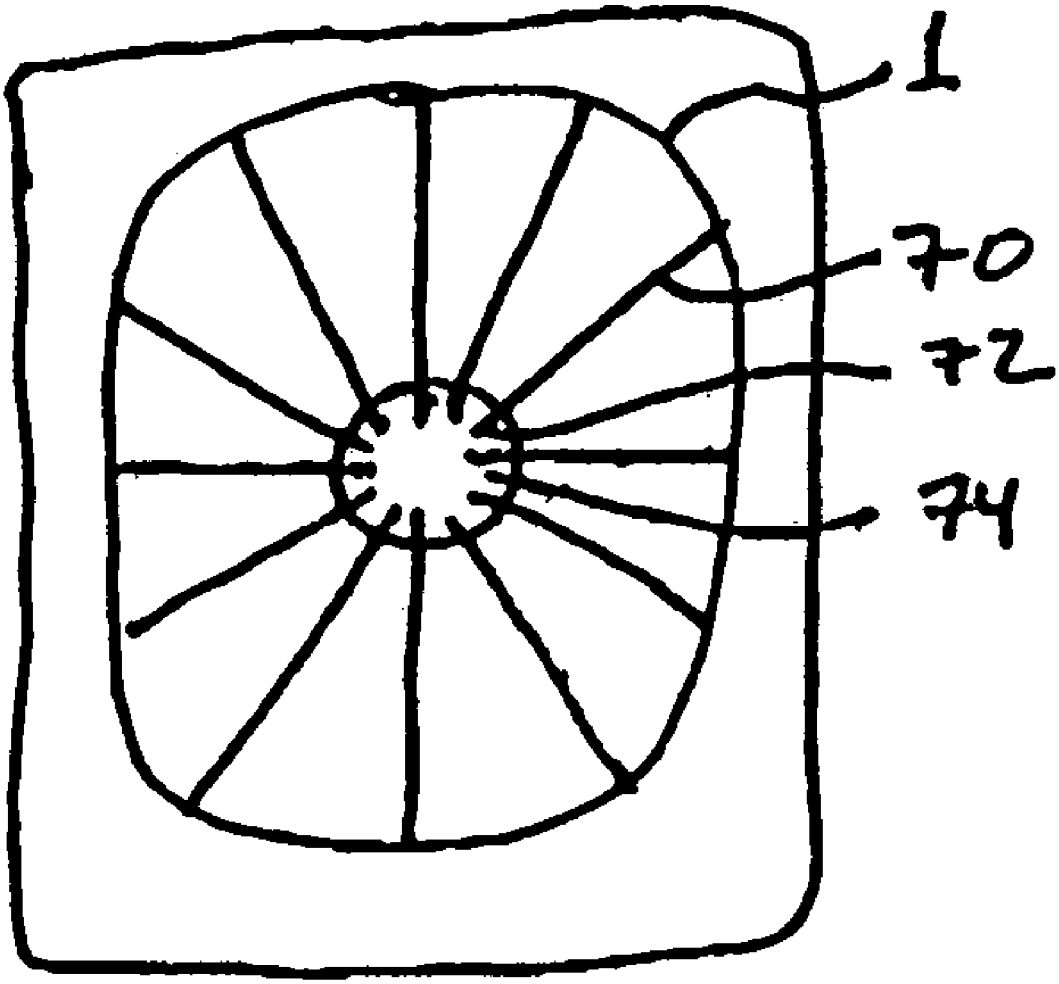
FIG. 7 shows the delivery contour of FIG. 3 with the rotor and vanes therein.

A delivery contour according to the present invention of a 12-vane pump is illustrated in FIG. 3, with the pump with 12-vanes 70 in rotor slots 72 in a rotor 74 being shows in FIG. 7. The description of delivery contour 1 begins again at 0 degrees, at angular point 3. However, since the 12-vane pump has a vane pitch of 30° instead of 36°, the small circle region, which had amounted to 30° in the case of the 10-vane pump, may be reduced by these 6° to 24°, with the result that the rise zone of the delivery contour begins at 12°, at angular point 30, following half of a small circle region. The rise zone of the delivery contour, i.e., the suction region, still spans 54°, as in the case of the contours from FIGS. 1 and 2, and thus ends at 66°, at angular point 32, thus, in turn, 3° earlier than in the case of the 10-vane pumps. By retaining the same-sized suction region as in the delivery contours of FIGS. 1 and 2, the length of the suction region continues to be advantageously useful with respect to reaching the maximum speed. The turning point of the displacement contour function in the rise zone should advantageously lie in the middle of the rise zone and, therefore, resides at angular point 34, at approximately 37.5°. The large circle region of this delivery contour now extends from angular point 32, at 66°, to angular point 36, at 118°, and is thus once again lengthened by 3° as compared to the delivery contour from FIG. 2, respectively by 10° as compared to the delivery contour of FIG. 1, which, in turn, is beneficial with regard to improving pressure equalization processes using foamed transmission oil. The fall zone, thus the pressure region of this delivery contour, extends from angular point 36, at 118°, to angular point 38, at 168°, where the delivery contour then passes into the next small circle region again. The turning point of the displacement contour function in the fall zone resides at angular point 40, at 141.7°, and is thus spaced 104° from the turning point at angular point 34, which is roughly equivalent to 3.5 times the 30° vane pitch of the 12-vane pump. Turning point 40 in the fall zone, thus in the pressure region, is spaced apart from the next turning point at angular point 42, by approximately 2.5 times the vane pitch of 30°.

Due to the smaller vane pitch of 30° in the case of the 12-vane pump, the difference between the large circle length and the vane pitch is now 22° as compared to 6° in the case of the standard 10-vane contour and 13° as compared to the improved 10-vane contour from FIG. 2. The compression region may even be lengthened, in turn, by 3° as compared to the shortened compression region from FIG. 2. Thus, the turning points in the transition functions of the displacement contour have a factor of x.5 times the vane pitch, which is the basis for an effective superposition of lower-vane and upper-vane pressure pulsation. The object of the present invention is to form the available angles in the large circle region to be as long as possible, since the noise generated when working with foamed transmission oil is mainly dominated by the pressure equalization processes and not by the geometrically produced volume flow pulsation. In the case of this contour as well, the compression region is somewhat shorter than the suction region, and the turning points are minimally rotated further, as a pair.

Figure 4:
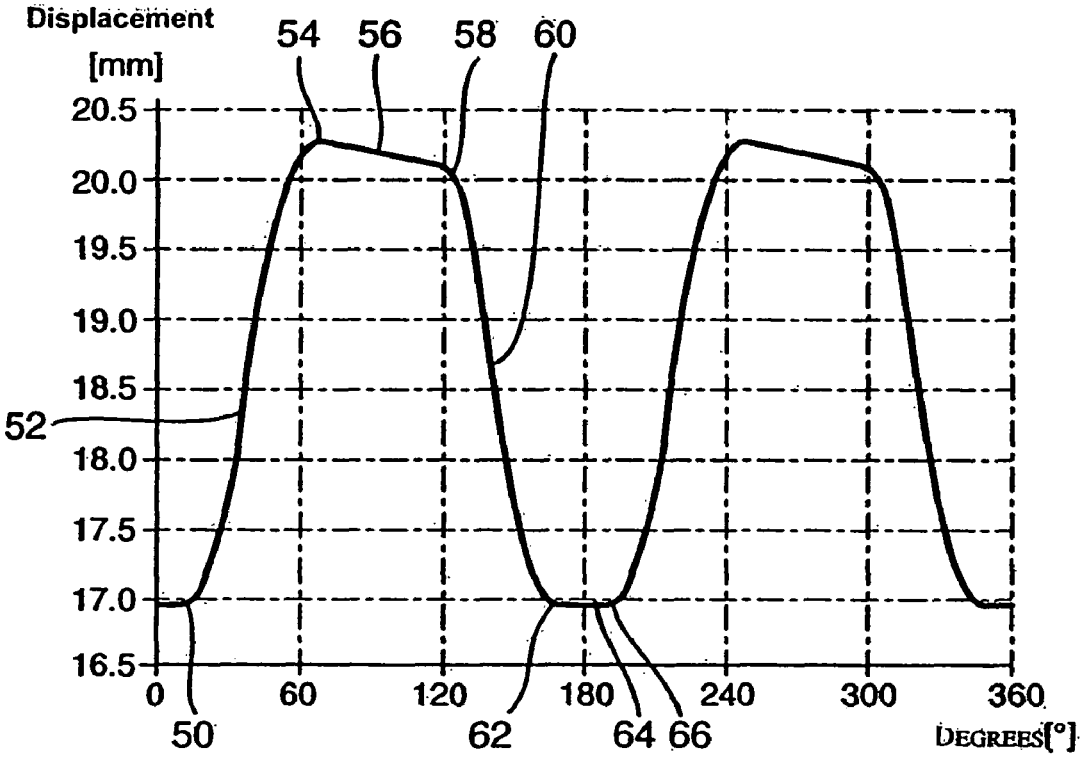
FIG. 4 illustrates the function of the displacement of a 12-vane delivery contour according to the present invention over the angle of rotation.

FIG. 4 shows the displacement contour function of the 12-vane contour from FIG. 3, having a lengthened "fall", over the angle of rotation. The rise in the contour begins at point 50 (corresponds to point 30 in FIG. 3) and continues to point 54. Large circle region 56 begins at point 54 (point 32 in FIG. 3) at approximately 66°. In large circle region 56, the vane displacement is constantly reduced as a function of the so-called "fall", to point 58 (point 36 in FIG. 3), fall 60 of the contour then extending to point 62 (point 38 in FIG. 3). Small circle region 64, which extends to point 66, then begins at point 62. The rise in the contour subsequently begins in the same manner as from point 50. It is clearly discernible in this developed view of the displacement contour that large circle region 56 could be decisively lengthened relative to small circle region 64, which, in the case of the 12-vane pump here, extends over a region of 30° minus 6°.

Figure 5:
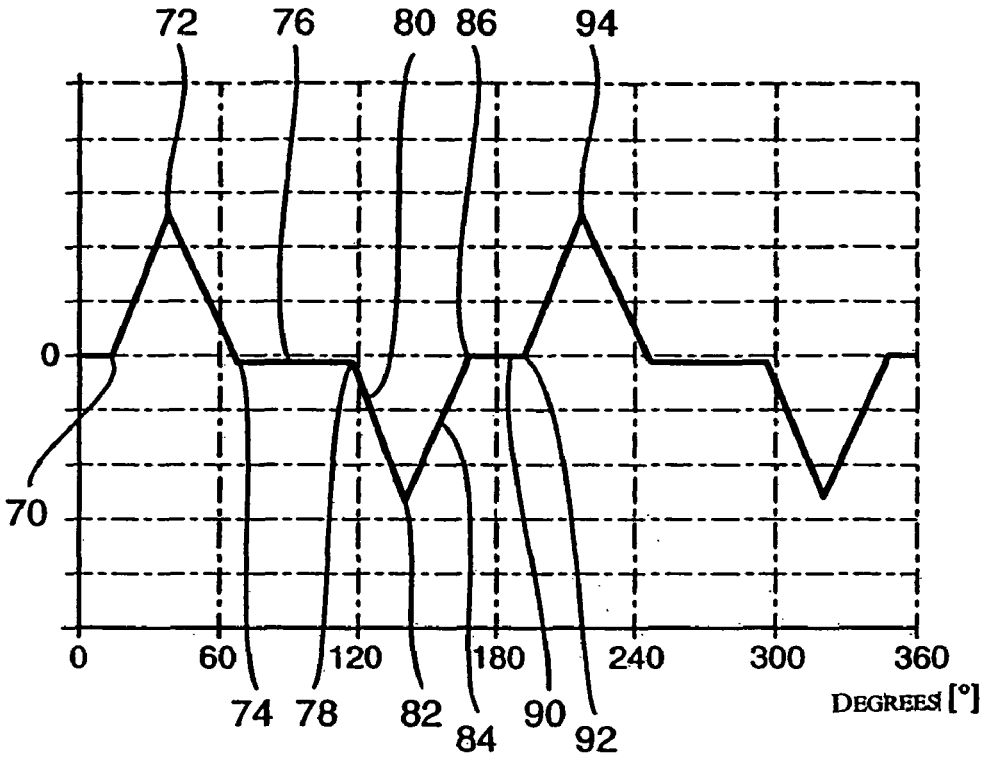
FIG. 5 shows the function of the derivative of the displacement with respect to the angle of rotation of a 12-vane delivery contour according to the present invention over the angle of rotation.

FIG. 5 shows the function of the derivative of the vane displacement with respect to the angle of rotation of the contour from FIG. 3, over the angle of rotation. At point 70 (point 30 in FIG. 3), the rise in the contour begins, along with an increasing amount of the derivative of the vane displacement with respect to the angle of rotation and, at point 72, has its maximum (point 34 in FIG. 3), whereupon the amount of the derivative of the vane displacement with respect to the angle of rotation again steadily decreases to point 74 (point 32 in FIG. 3). At point 74, the transition to the large circle region then follows, whose derivative is represented by the curve of line 76. At point 78 (point 36 in FIG. 3), large circle region 76 enters into the transition function in small circle direction that initially begins with a decreasing amount of the derivative of the vane displacement with respect to the angle of rotation, which is represented by function curve 80, until, from minimum 82 on (point 40 in FIG. 3), the amount of the derivative of the vane displacement with respect to the angle of rotation again increases, as represented by function region 84. At point 86 (point 38 in FIG. 3), small circle region 90 is then reached, which extends to point 92. From point 92 on, the function curve is again repeated as from point 70 on. Between maximum 72 and minimum 82 (turning points of the displacement contour function), a spacing of 3.5 times the vane pitch results, while from minimum 82 to the next maximum 94, a spacing of approximately 2.5 times the vane pitch results. This spacing of the turning points of the displacement function is the basis for an effective superposition of lower-vane and upper-vane pulsation, as already described previously.

Figure 6:
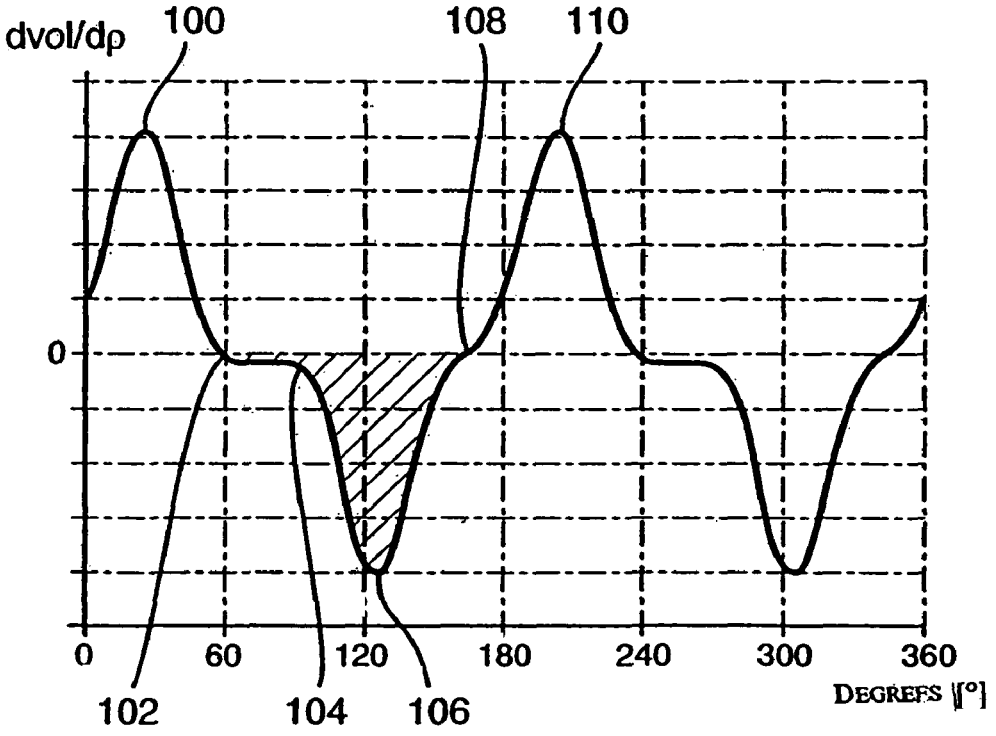
FIG. 6 shows the function of the derivative of the cell volume with respect to the angle of rotation, plotted over the angle of rotation, of a 12-vane delivery contour according to the present invention.

FIG. 6 shows the derivative of the cell volume with respect to the angle of rotation of the contour from FIG. 3, over the angle of rotation. The suction process is characterized by a progressive increase in the cell volume to point 100 and, subsequently, by a degressive increase in the cell volume to point 102. The volume is subsequently continuously reduced to a small extent in the large circle region as a function of the "fall", until, from point 104 on, the actual compression process takes place, with a progressive decrease in volume to point 106, and then with a degressive decrease in volume to point 108. As the small circle region is passed through, the volume is then progressively increased to point 110, the process first described then being repeated for the second time. Also evident in this function of the derivative of the cell volume with respect to the angle is, in turn, between points 100 and 106, for example, the spacing of the turning points of the displacement contour function of 3.5 times the vane pitch and, from point 106 to point 110, of 2.5 times the vane pitch.

What is claimed is:

1. A pump comprising:

a double-stroke delivery contour, the delivery contour having at least one rise zone, at least one large circle region, at least one fall zone, and at least one small circle region, and, a rotor within the delivery contour, the rotor having radially displaceable vanes in radial rotor slots, an angular range of the large circle region of the delivery contour being lengthened, wherein the large circle region is greater than the fall zone.

2. The pump as recited in claim 1 wherein the pump is a transmission pump.

3. The pump as recited in claim 1 wherein the pump is a 10 vane pump and the large circle region of the delivery contour on one side is between 48 and 51 degrees.

4. The pump as recited in claim 3 wherein the large circle region on one side extends 49 degrees.

5. The pump as recited in claim 1 wherein the pump is a 12 vane pump and the large circle region of the delivery contour on one side is between 51 and 55 degrees.

6. The pump as recited in claim 5 wherein the large circle region on one side extends 52 degrees.

7. The pump as recited in claim 1 wherein a length of a suction region is not lengthened.

8. The pump as recited in claim 1 wherein the pump is a 12 vane pump, and turning points of a displacement contour function in a direction from a suction region to a pressure region are spaced apart by approximately 105 degrees.

9. The pump as recited in claim 1 wherein the pump is a 10 vane pump, and turning points of a displacement contour function in a direction from a pressure region to a suction region are spaced apart by approximately 90 degrees.

10. The pump as recited in claim 1 wherein the pump is a 10 vane pump, turning points of a displacement contour function being shifted by approximately 3° in direction of rotation.

11. The pump as recited in claim 1 wherein turning points of a displacement contour function are not spaced evenly about the delivery contour.

* * * * *